US005431101A

United States Patent [19]

Arrell, Jr. et al.

[11] Patent Number: 5,431,101

[45] Date of Patent: Jul. 11, 1995

[54] LOW COST HERMETICALLY SEALED SQUIB

[75] Inventors: John A. Arrell, Jr., Lincoln University, Pa.; Peter L. Atkeson; John W. Cooper, both of Newark, Del.; Paul P. Hebert, Bear, Del.

[73] Assignee: Thiokol Corporation, Ogden, Utah

[21] Appl. No.: 964,636

[22] Filed: Oct. 22, 1992

Related U.S. Application Data

[63] Continuation-in-part of Ser. No. 686,187, Apr. 16, 1991, Pat. No. 5,230,287.

[51] Int. Cl.[6] ..... F42C 19/12

[52] U.S. Cl. ..... 102/202.5; 102/202.14

[58] Field of Search ..... 102/202, 202.1, 202.2, 102/202.3, 202.5, 202.7, 202.8, 202.9, 202.14; 86/10

[56] References Cited

U.S. PATENT DOCUMENTS

| | | | |
|---|---|---|---|
| 1,606,417 | 11/1926 | Grant | 102/202.3 |
| 2,882,820 | 4/1959 | Young | 102/202.14 |
| 3,018,732 | 1/1962 | Tognola | 102/202.5 |
| 3,019,732 | 2/1962 | Kaspaul | 102/202.5 |
| 3,082,691 | 3/1963 | Evans et al. | 102/202.14 |
| 3,135,200 | 6/1964 | Jackson | 102/202.9 |
| 3,208,379 | 9/1965 | McKee et al. | 102/202.5 |
| 3,211,096 | 10/1965 | Forney et al. | 102/202.5 |
| 3,249,047 | 5/1966 | Gill et al. | 102/202.14 |
| 3,292,537 | 12/1966 | Grass, Jr. | 102/202.5 |
| 3,366,055 | 1/1968 | Hollander, Jr. | 102/202.5 |
| 3,726,217 | 10/1973 | Dedman et al. | 102/202.5 |
| 3,978,791 | 9/1976 | Lemley et al. | 102/202.5 |
| 4,103,619 | 8/1978 | Fletcher | 102/202.5 |
| 4,110,813 | 8/1978 | Hoheisel et al. | 102/202.9 |
| 4,144,814 | 3/1979 | Day et al. | 102/202.5 |
| 4,170,939 | 10/1979 | Hoheisel et al. | 102/202.3 |
| 4,208,967 | 6/1980 | Betts | 102/202.14 |
| 4,306,499 | 12/1981 | Holmes | 102/202.9 |
| 4,378,738 | 4/1983 | Proctor et al. | 102/202.7 |
| 4,402,269 | 9/1983 | Smith | 102/202.14 |
| 4,578,247 | 3/1986 | Bolieau | 102/531 |
| 4,708,060 | 11/1987 | Bickes, Jr. et al. | 102/202.7 |
| 4,729,315 | 3/1988 | Proffit et al. | 102/202.9 |
| 4,951,570 | 8/1990 | La Mural et al. | 102/202.9 |
| 5,014,062 | 5/1991 | Schriner et al. | 102/207.8 |
| 5,029,529 | 7/1991 | Mandigo et al. | 102/202.9 |
| 5,035,179 | 7/1991 | Bender et al. | 102/202.5 |
| 5,230,287 | 7/1993 | Arrell, Jr. et al. | 102/202.5 |

FOREIGN PATENT DOCUMENTS

| | | | |
|---|---|---|---|
| 2945803 | 5/1981 | Germany | 102/202.5 |
| 3416735 | 11/1985 | Germany | 102/202.5 |

*Primary Examiner*—Harold J. Tudor

*Attorney, Agent, or Firm*—Madson & Metcalf; Ronald L. Lyons

[57] ABSTRACT

An electrically actuated igniter squib is formed by welding a cup containing a pyrotechnic material to a header inserted in the cup, thus forming a hermetic seal. The diameter of the header exceeds the diameter of the cup and the two are joined by forcing, under pressure, the header into the cup to achieve a tight readily welded joint.

27 Claims, 8 Drawing Sheets

LOW COST HERMETICALLY SEALED SQUIB

This application is a continuation-in-part of U.S. Ser. No. 07/686,187, filed Apr. 16, 1991, now U.S. Pat. No. 5,230,287.

BACKGROUND OF THE INVENTION

1. Field of the Invention

The invention relates to electroexplosive initiating devices and, more particularly, pertains to squibs useful for initiating the ignition or detonation of propellants, pyrotechnics, explosive materials, and the like.

2. State of the Art

Various means are known for initiating the detonation or ignition of energetic materials. Such initiating devices are variously known as initiators, blasting caps, detonation primers, headers, and squibs, depending upon the particular use. In each case, the initiating device comprises the first element in an igniter explosive train.

The electrical device initiating the explosive effect may be a hot wire bridge, a graphite bridge, a conductive mix of graphite and explosive material, a spark gap, an exploding bridge wire, a semiconductor bridge (SCB), or other means, all of which are known in the art.

Squibs are commonly used for initiating the firing of solid propellant rocket motors and gas generation devices such as automotive vehicle "air bag" safety devices. These squibs must therefore be extremely reliable even after years of exposure to extreme temperature variations, vibration, and other environmental factors.

The construction of prior art squibs is such that intimate contact between the initiating device and pyrotechnic material within the squib is not always ensured. In addition, the hermetic seal may disintegrate in time. Furthermore, fabrication of the squib is complex and costly.

There remains the need for a reliable squib which may be mass produced at low cost.

SUMMARY OF THE INVENTION

The invention is an improved squib design and method of fabricating same in which an initiating element is placed in intimate contact with a compressed load of pyrotechnic material and the element and pyrotechnic material hermetically sealed in the squib by welding.

The squib is producible in high volume by primarily automated techniques, thus achieving a high reliability at low cost.

The intended uses of the squib include, but are not limited to, automotive vehicle crash bag inflaters, rocket motors, rocket stage separation devices, warhead detonators, flares, and ejectibles. For these applications, the squib is of small size, typically 0.2 to 0.5 inch in each dimension.

The squib of the invention includes a weldable metallic cup or case which contains a charge of pyrotechnic material. The pyrotechnic material is typically a small, e.g. 100 mg. charge of powdered energetic material such as titanium subhydride potassium perchlorate, titanium dihydride potassium perchlorate, boron potassium nitrate, and the like.

A cylindrical header, a portion of which is formed of weldable metal, has an outer diameter which is slightly, e.g. 0.005 inch, larger than the inside diameter of the cup. One end of the header has an electrically actuated initiating element mounted thereon, and electrically conducting pins are connected to the initiating element and sealingly pass through the header for connection to an electrical firing circuit.

The squib is assembled by pressing the element mounted end of the header into the slightly smaller cup, thus expanding the cup walls and ensuring that the cup walls embrace the header. The header is thus forced into the cup against the pyrotechnic material to compress and densify it.

The cup and the metallic portion of the header are then circumferentially welded to provide a continuous hermetic seal therebetween.

The pyrotechnic material may optionally be precompressed within-the cup prior to installing the header by use of a small ram. In this case, only a small portion, if any, of the densification of the pyrotechnic material is achieved by the pressure of the header.

The particular initiating element may be any electrically actuated device which will ignite the pyrotechnic material in the cup. A preferred element is a semiconductor bridge (SCB) as described herein.

Joining the cup and the header by a continuous weld, e.g. laser weld or resistance weld, produces a very strong and reliable hermetic seal which is resistant to environmental factors. Furthermore, the steps of pyrotechnic charging, charge compression, assembly, and welding may all be automated to ensure accuracy and a high speed manufacturing process.

The header may be configured with mounting means thereon for mounting of the squib adjacent the energetic material which is to be ignited. Alternatively, the header portion may be encased in a jacket of plastic or other material which is configured for easy mounting.

Electrical actuation of the initiating element ignites the pyrotechnic material in the cup. The walls of the cup are melted and blown outward by the heat and pressure developed by the burning pyrotechnic material, thus igniting or detonating the energetic material of the rocket motor, gas generator, or other apparatus.

This invention is also the igniter squib wherein the closed end of the cup contains a resilient material, preferably a polymer, more preferably a silicone rubber which can be contiguous to the entire closed end. Preferably the closed end of the cup also has a rigid plate between the resilient material and the pyrotechnic material. The plate can be plastic or metal and is preferably LEXAN®, carbonate thermoplastic produced by reacting bisphenol A and phosgene.

In another embodiment this invention is an igniter squib where the appropriate portion of the electrical ignition element is connected to a loop of wire which is also connected to one of the electrically conductive pins and the loop extends into the pyrotechnic material.

The process of this invention also includes the step wherein prior to placing the measured charge into the open end of the cup, the additional step is taken of placing a resilient material in the closed end of the cup. Another embodiment for the process of this invention is wherein after placing the resilient material in the closed end of the cup and before placing the measured charge into the open-end of the cup the additional step is taken of placing a rigid plate over the resilient material. The process also includes the step wherein the joining of the pins to the respective terminal means of the initiating element means is by means of wire loops which extend into the subsequently placed charge of pyrotechnic material.

BRIEF DESCRIPTION OF THE DRAWINGS

The various features and attendant advantages of the invention will become clear when considered in light of the accompanying drawings, wherein.

DESCRIPTION OF THE ILLUSTRATED EMBODIMENTS

In each of the embodiments shown and described herein, the initiating element is depicted as a semiconductor bridge (SCB), but the invention is not to be limited thereby. The initiating element may alternatively be a hot wire bridge, a spark gap, exploding bridge wire, or other initiating device.

Figure 1:
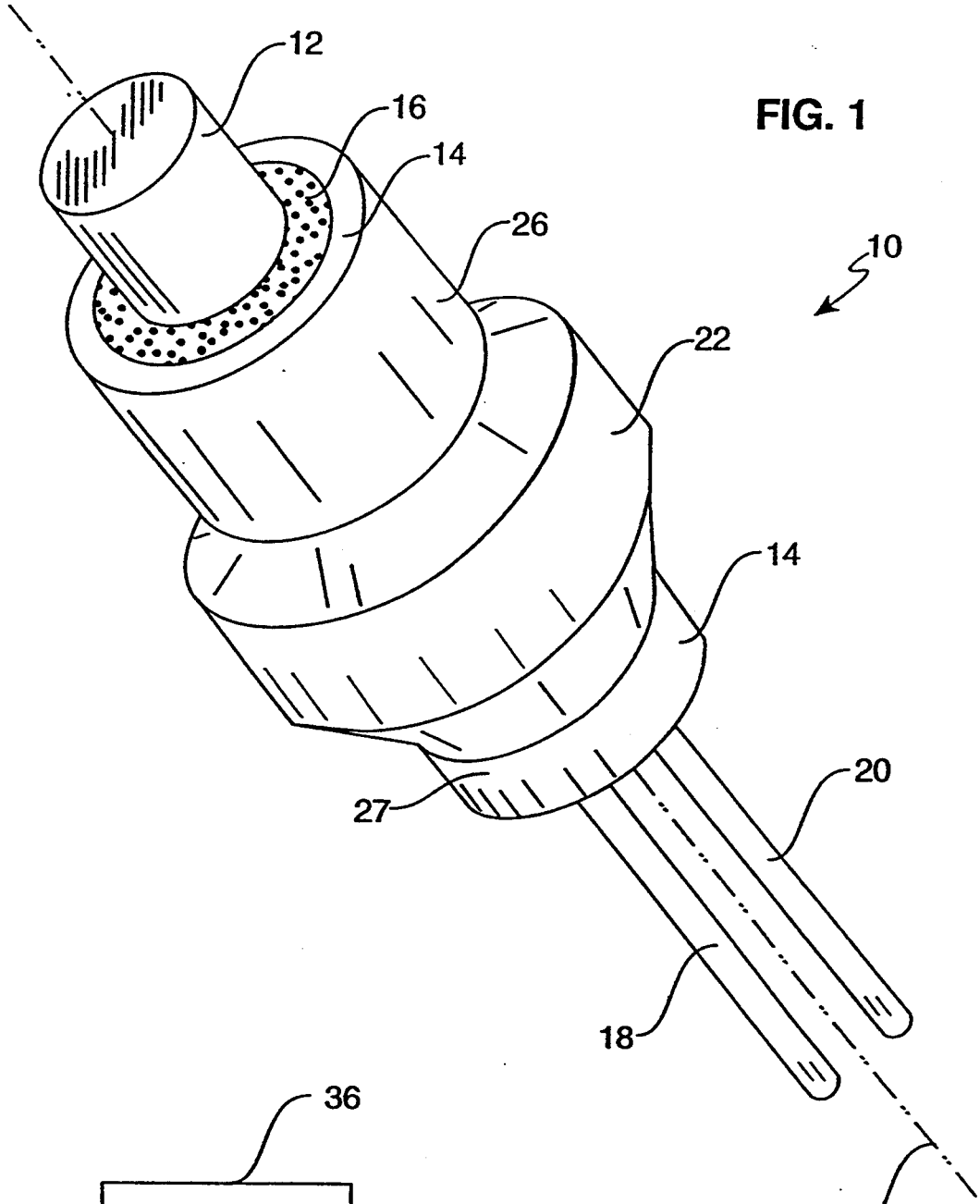
FIG. 1 is a perspective view of the squib of the invention.

As shown in FIG. 1, the hermetically sealed semiconductor bridge (SCB) squib 10 of the invention is shown as including a metallic case or cup 12 cemented into non-conductive jacket 14 by adhesive 16. Electrically conductive terminals or pins 18 and 20 pass through the jacket 14 and into the cup 12 for energizing a semiconductor bridge to ignite a pyrotechnic material therein. At least one of the pins 18, 20 is fully insulated from the cup 12. The pyrotechnic material as well as the SCB igniter assembly is carried within cup 12. When the SCB is energized, the ignited pyrotechnic material instantaneously detonates or burns to rupture the exposed portions of cup 12 for igniting a propellant, explosive, or other gas generating material adjacent the squib 10.

Jacket 14 is shown as having an enlarged radial portion 22 for sealing attachment in the squib within the gas generator, rocket combustion chamber, or explosive device. The squib 10 is shown as being symmetrical about a plane passing through longitudinal axis 24. A portion of the cup 12 and other elements of the device are embedded in adhesive 16 within the shank 26, enlarged radial portion 22 and terminal end 27 of jacket 14.

Figure 2:
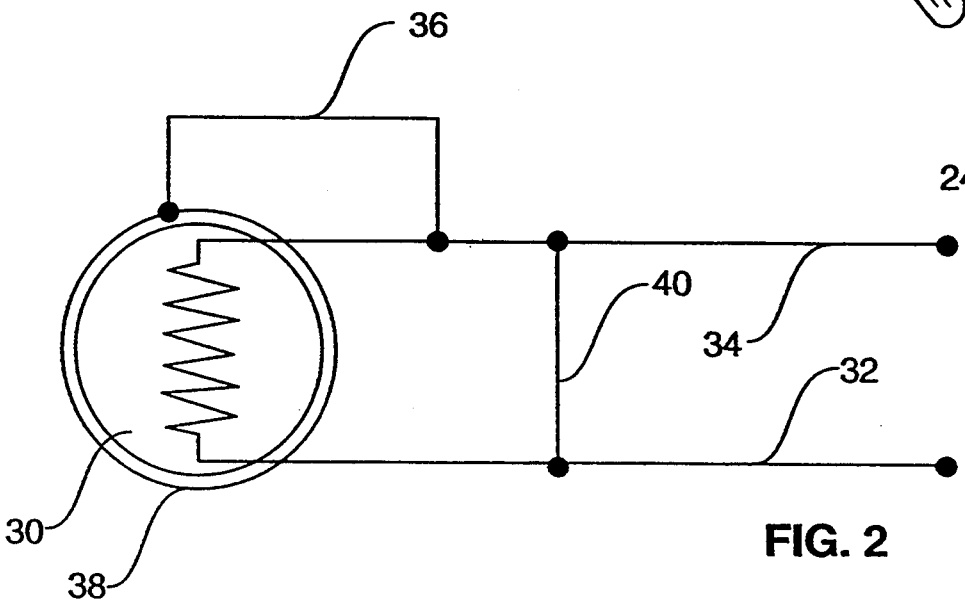
FIG. 2 is a schematic circuit diagram in accordance with the invention.

FIG. 2 depicts the electrical schematic configuration of the squib. The initiating element 30 is shown as a semiconductor bridge which acts as a resistance member having a negative temperature coefficient of electrical resistivity at an elevated temperature. When a predetermined electrical current passes through bridge 30, the semiconductor bridge 30 bursts and burns to ignite the pyrotechnic material in cup 12. Electrical terminals 32 and 34 represent pins 18 and 20 of FIG. 1 for energizing the SCB 30. One of the terminals, e.g. terminal 34, is shown as being permanently grounded by connection 36 to case 38. The figure also shows a removable shunt 40 between terminals 32 and 34 for preventing accidental discharge of the squib prior to its installation or intended use.

The electrical continuity of the semiconductor bridge squib may be readily determined without firing the squib. A subcritical voltage is applied across terminals 32, 34, and the resulting current passing through the SCB is determined.

Figure 3:
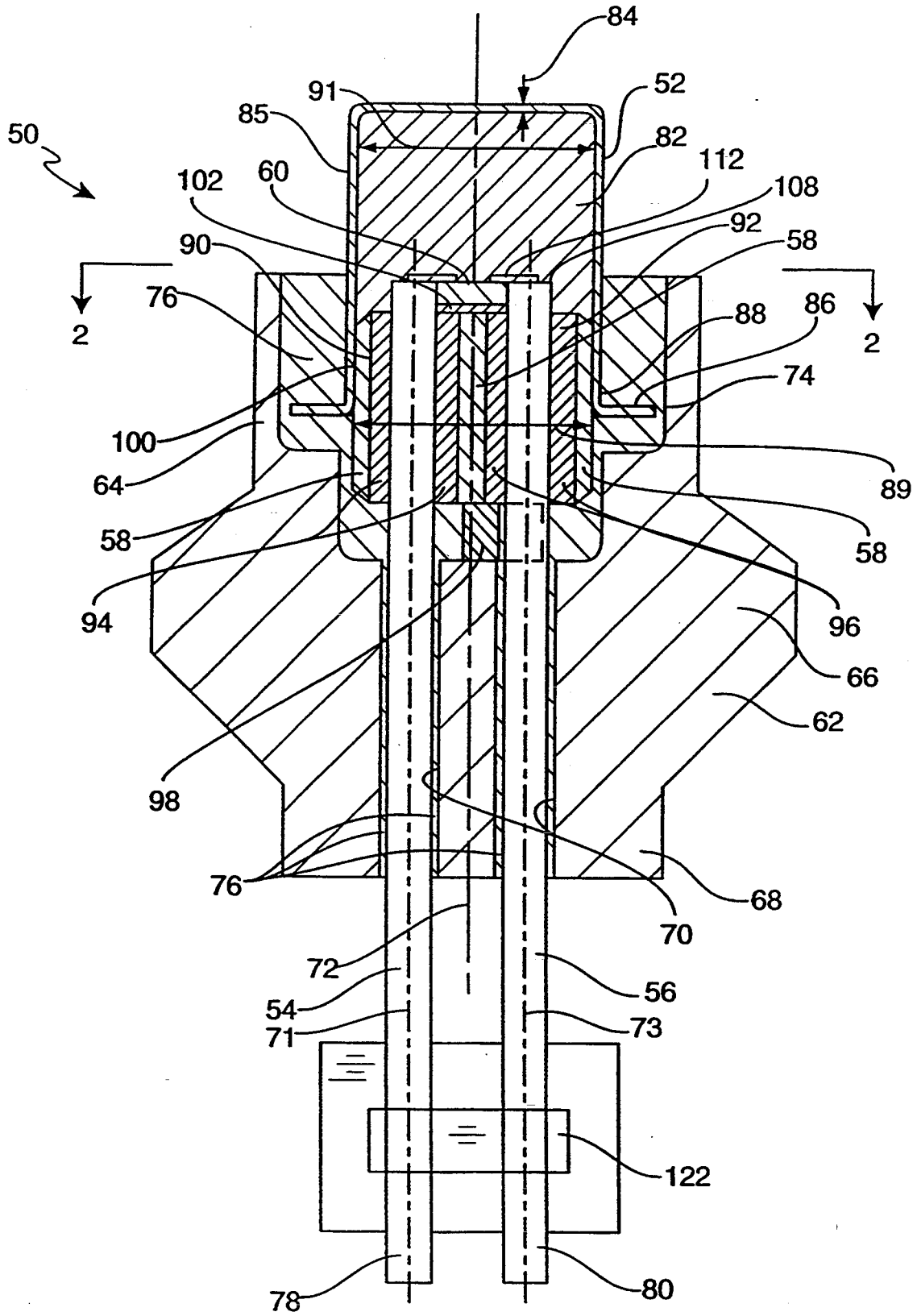
FIG. 3 is a cross-sectional side view of the squib of the invention.

As shown in FIG. 3, one embodiment of the SCB squib assembly 50 is shown in cross-section. The major elements of the assembly 50 include a cup or case 52, electrically conducting pins 54 and 56 rigidly mounted in header body 58, an initiating element, e.g. an SCB element 60 which is connected to pins 54 and 56, and an electrically non-conductive jacket 62. The jacket 62 provides a means for sealingly mounting the squib in the particular apparatus to be fired and is adaptedly configured for the application.

As shown in the figure, jacket 62 includes a shank 64, an enlarged central portion 66, and a terminal end, 58. The jacket 62 has through holes 70 with axes 71 and 73 parallel to longitudinal axis 72 for passage of pins 54 and 56 therethrough.

In the embodiment shown, a depression 74 is formed in the jacket for receiving and encapsulating a portion of the case 52 as well as the header body 58. An adhesive 76 is injected in the space between (a) the cup 52, header 58, and pins 54, 56, and (b) the jacket 62. When cured, the adhesive 76 provides a semi-rigid secondary hermetic seal for the contents of the cup 52. The terminal portions 78, 80 of pins 54, 56 are exposed for attachment to a power source for activation of the device. An adhesive useful for this purpose is an epoxy material sold as PRONTO® CA100 which cures in to 1 ten seconds at a temperature of about 75°±15° F. The jacket is formed of a non-conductive material, e.g. a plastic material such as a polyurethane/polycarbonate blend sold under the name SUPER TOUGH 66® nylon, part No. 3M669.

The case or cup 52 is generally cylindrical in shape and is formed of a conductive, weldable metal such as stainless steel or other corrosion-resistant alloy for holding a measured charge 82 of pyrotechnic material. The cup 52 may be formed by stamping, machining, or other process. The thickness 84 of case walls 85 is typically 0.005 to 0.010 inches.

Header body 58 is a cylindrical member which has an outer diameter 89 slightly larger than the inside diameter 91 of the cup 52. It is shown formed of an electrically conductive, weldable metal such as stainless steel coated with copper and electroless nickel with eight percent phosphorus outside the weld zone. Thus, to assemble the cup 52 and header 58, the header is inserted and forced under pressure, such as about 15,000 psi, into the cup 52 containing pyrotechnic material. The cup 52 expands under the force and strongly embraces the header 58.

The header is preferably inserted under sufficient pressure to compress the pyrotechnic material 82 or further compress the pyrotechnic material if predensified in the cup 52 by a ram, not shown.

Header body 58 has through holes 90, 92 for passage of conducting pins 54, 56 therethrough. Pins 54 and 56 are held rigidly in place in header body 58 by vitreous insulative seals 94, 96 such as glass or ceramic. Seals 94, 96 may be preforms which are positioned in place and heated to melt and sealingly fuse the pins into the header body 58. Thus, in a preferred form, a steel header 58 contains two pins of type 52 alloy that are compression sealed using Corning® 9013 glass. The thermal coefficients of expansion of the heat-treated maraging steel are compatible with the type 9013 glass. The glass seals meet a $1\times10^{-6}$ cc/second helium leak rate requirement and will withstand dynamic pressures of 207 MPa (30 ksi) during firing. Pressure capability in hydrostatic tests is desirably about 450 MPa (65 ksi).

As shown in FIG. 3, the header body 58 is welded to the wall 85 of pyrotechnic containing cup 52 at general weld location 100. A laser welding technique is preferred, but other methods such as resistance welding may be used.

FIG. 3 depicts one pin 56 as being grounded to header body 58 and cup 52 by shorting ring 98. The shorting ring 98 is welded or soldered to both pin 56 and header body 58. However, one pin could be mechanically attached to the header body 58 to provide continuous grounding. The pins 54 and 56 are formed of metal wire, typically iron-nickel alloy wire, which is nickel plated, or KOVAR®. The pins may alternatively be gold plated. The metal must be compatible with the pyrotechnic material and be readily joined by welding or soldering methods to the initiating element 60.

Figure 4:
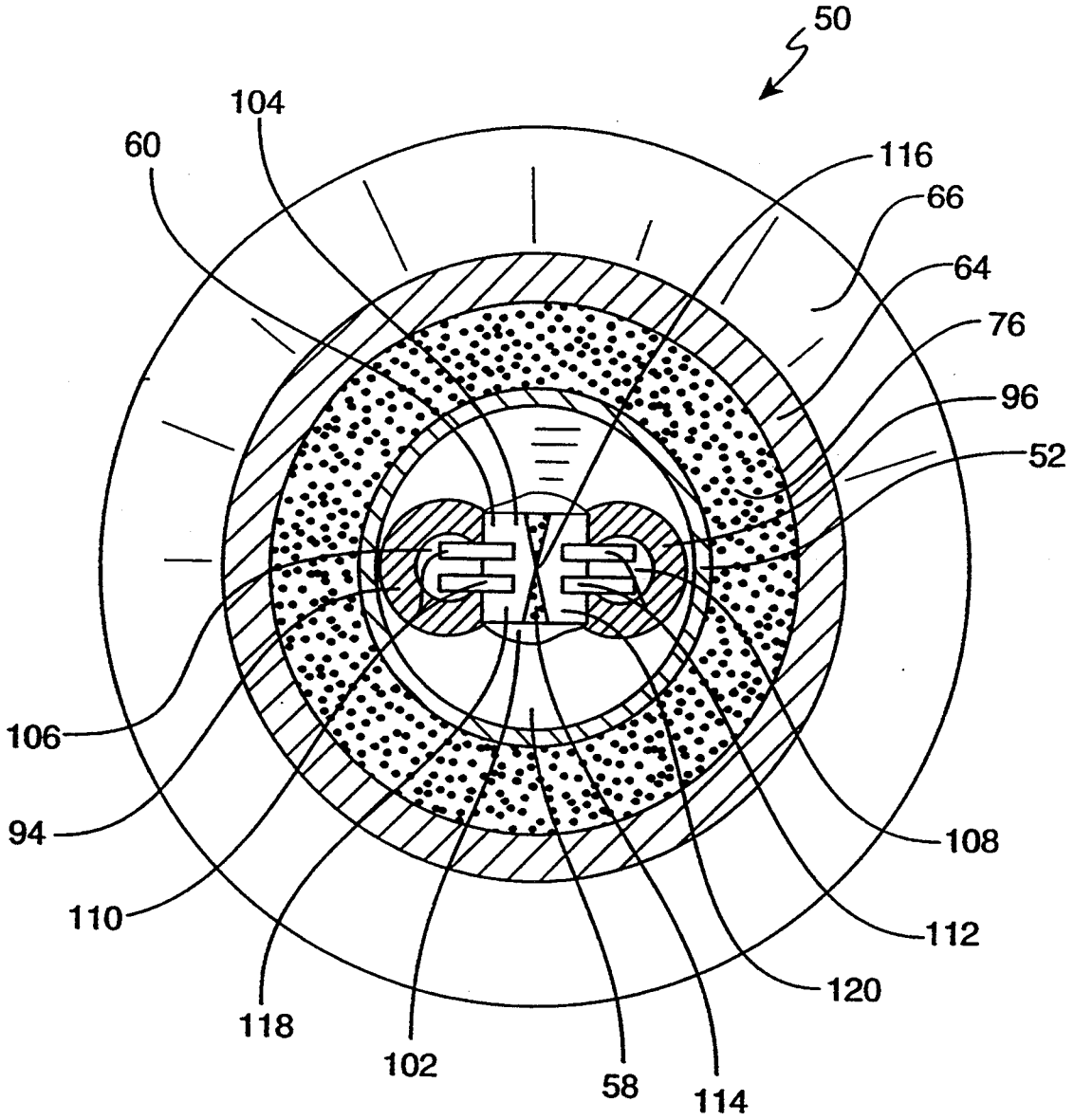
FIG. 4 is a cross-sectional end view taken along lines 2—2 of FIG. 1.

In discussing the SCB element, i.e. chip 60, and its attachment to the header body 58, it is helpful to compare FIG. 3 with the cross-sectional end view presented in FIG. 4.

FIG. 4 depicts some of the major elements of the squib assembly 50 including cup or case 52, header body 58, adhesive 76, as well as the shank 64, and enlarged central portion 66 of jacket 62. The ends 106 and 108 of pins 54 and 56 are shown as extending through the header body 58 and positioned to be surrounded by vitreous insulative seals 94, 96 as described herein.

An SCB chip 60 is positioned between pins 54 and 56 and is fixedly bonded to the flat surface of header body 58 by an adhesive 102. Various configurations of SCB chips useful in squibs are well-known in the art. The particular chip 60 shown in FIGS. 3 and 4 has a semiconducting layer 114. Two metallic, e.g. aluminum, lands 118 and 120 of about 1 to 10 micron thickness overlay the layer 114 and are joined by a bridge 116 therebetween. The size of bridge 116 is typically on the order of about 0.01 inch square.

The top surfaces 104 of the lands 118 and 120 are preferably positioned to be level with the ends 106, 108 of the pins 54, 56 for electrically joining the pins to the chip with metal first and second connectors 110 and 112. Typically, the connectors could be strips or wire which are heavy wire bonded to the pins and the lands of SCB chip 60. The connectors 110 and 112 may be formed of wire. For example, 0.005 inch diameter wire of aluminum works well. The electrical resistance across the SCB chip, as measured with a 15 mA maximum DC source, is controlled by the bridge size, land thickness, etc. to match the ignition power source. The SCB circuit resistance is typically on the order of one or two ohms.

In alternative constructions, connectors 110 and 112 are joined to the pins 54, 56, and lands 118, 120 by soldering or other means of wire bonding.

In a further alternative construction, tape automated bonding (TAB) is used to electrically join the pins 54, 56, and lands 118, 120. The connectors 110 and 112 are formed in a tape which is positioned over the SCB assembly. The connectors are then quickly joined to the pins and lands by thermal compression, soldering, or ultrasonic bonding. Both the TAB process or either fine or heavy wire bonding permits electrical connection to be made at high volume with very high reliability.

As shown in FIG. 3, pins 54 and 56 are depicted as being electrically joined by removable shunt 122. The shunt 122 prevents the buildup of any appreciable voltage across the SCB during fabrication, assembly, and installation.

The steps for manufacturing the squib 10 generally include:

(a) forming a cylindrical cup and header or header assembly. The header has a longitudinal passageway therethrough and includes an electrically conductive, weldable member having a circumferential surface which mates a circumferential surface of the cup. The pins are mounted and sealed in the header as described herein. The initiating element is mounted on the interior end of the header and its terminals joined to the conductive pins;

(b) placing a measured charge of pyrotechnic material in the cup and preconsolidating the charge;

(c) inserting the interior end of the header having the initiating element mounted thereon into the open end of the cup wherein the cup is expanded and tightly embraces the header. The pyrotechnic material is compressed by the interior end of the header causing densification thereof and resulting in intimate contact between the pyrotechnic material and the initiating element; and (d) welding the circumference of the cup to the corresponding matching circumference of the header in a continuous weld. The preferred method is laser welding, but other techniques, e.g. resistance welding, may be used.

Optional steps already described include the installation of a removable shunt across the pins, grounding of one of the pins to the welded members, and encasement of the header in a non-conductive jacket.

If desired, the pyrotechnic material placed in the cup is compacted in situ by a ram operating at pressures up to about 15,000 psi prior to installing the header. This results in about a threefold decrease in pyrotechnic volume in the cup.

Figure 5:
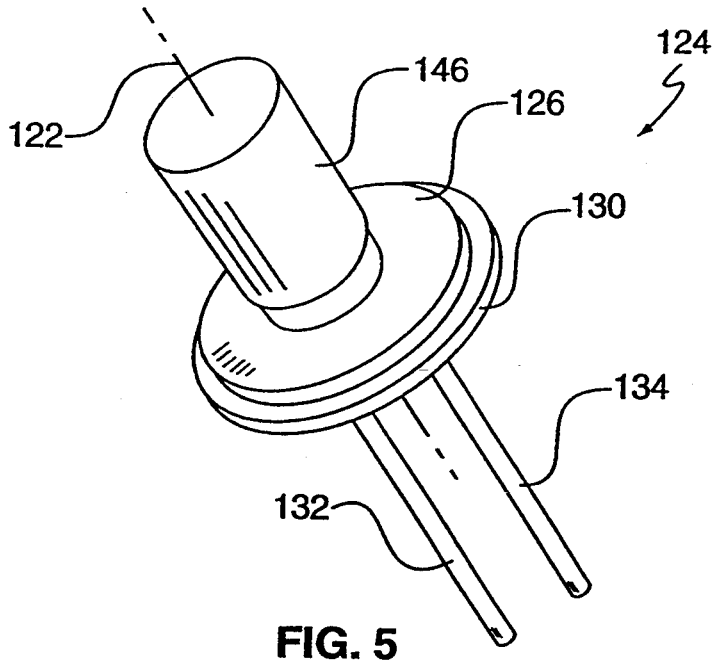
FIG. 5 is a perspective view of another embodiment of the squib of the invention.
Figure 6:
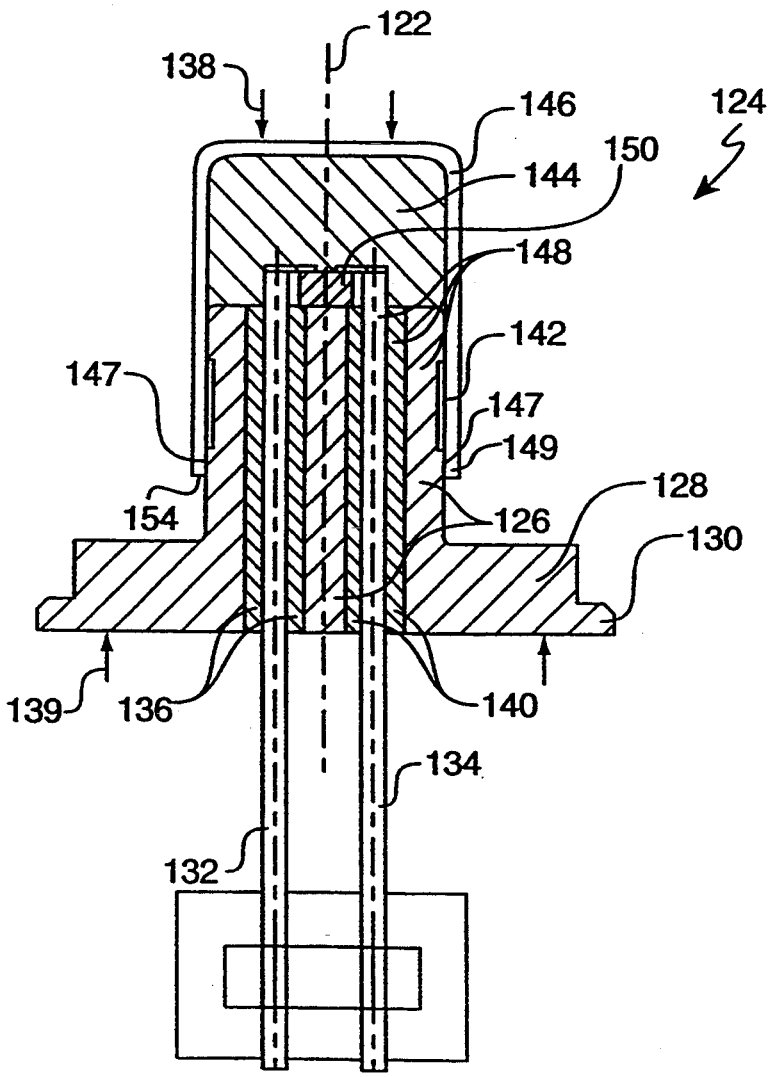
FIG. 6 is an enlarged cross-sectional side view of an embodiment of the squib.

Another embodiment of the squib is depicted in FIGS. 5 and 6. It is shown as aligned along axis 122. The SCB squib 124 differs from that of FIGS. 1 and 3 in that the header body 126 has a flange 128 formed at its external end. The flange 128 is shown with a lip 130 for mounting within a pyrotechnic gas generator, rocket motor, or the like. Terminals or pins 132 and 134 are provided as connections to a power source. As already described, the pins pass through the header body 126 and are insulated from it by vitreous insulative seals 136 and 140. The header body 126 is depicted with circumferential inset 142 for reducing the pressure required in installing the header body 126 into cup 146. In assembling the squib, pyrotechnic material 144 is placed in the cup 146 and optionally debulked by a ram as previously described. The header assembly 148, including SCB chip 150, pins 132, 134, and connections therebetween, is then compressed into cup or case 146 to form compressive Contact between the SCB chip 150 and the pyrotechnic material 144. The combination of forces on cup 146 in direction 138 and on flange 130 in direction 139 provide the necessary Compression. The header body 126 is then circumferentially welded to the cup 146 to form weld bead 147 near the end 149 of the cup 146. The weld line 147 forms a hermetic seal.

The squib 124 may be sealed in a non-conductive jacket, not shown, as already described in relation to FIGS. 1 and 3. Optionally, a coating of sealant such as a varnish may be applied to the circumferential joint 154 between cup 146 and header body 126. In either case, a secondary hermetic seal is formed.

Figure 7:
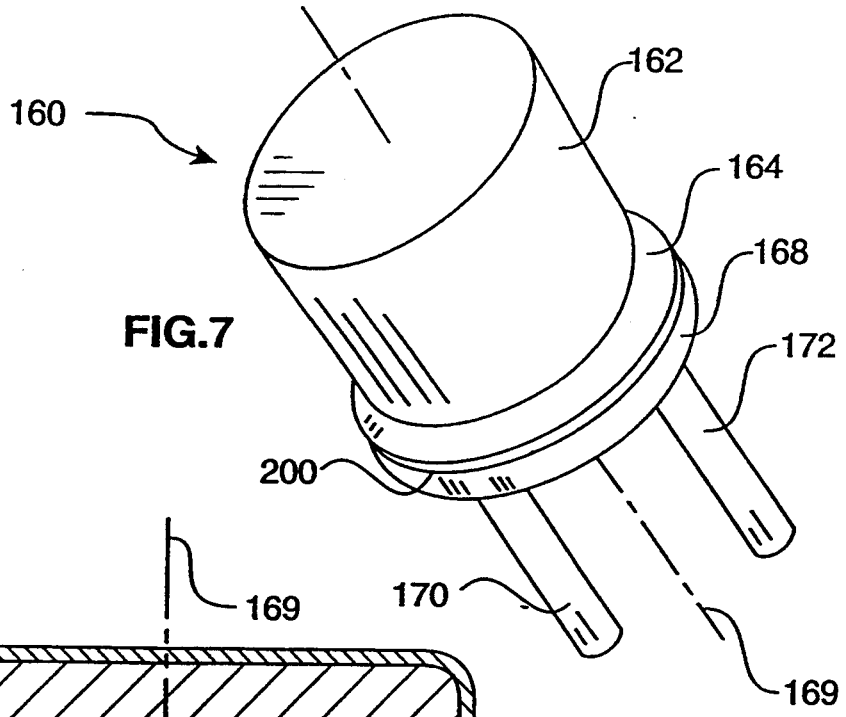
FIG. 7 is a perspective view of a further embodiment of the squib of the invention.
Figure 8:
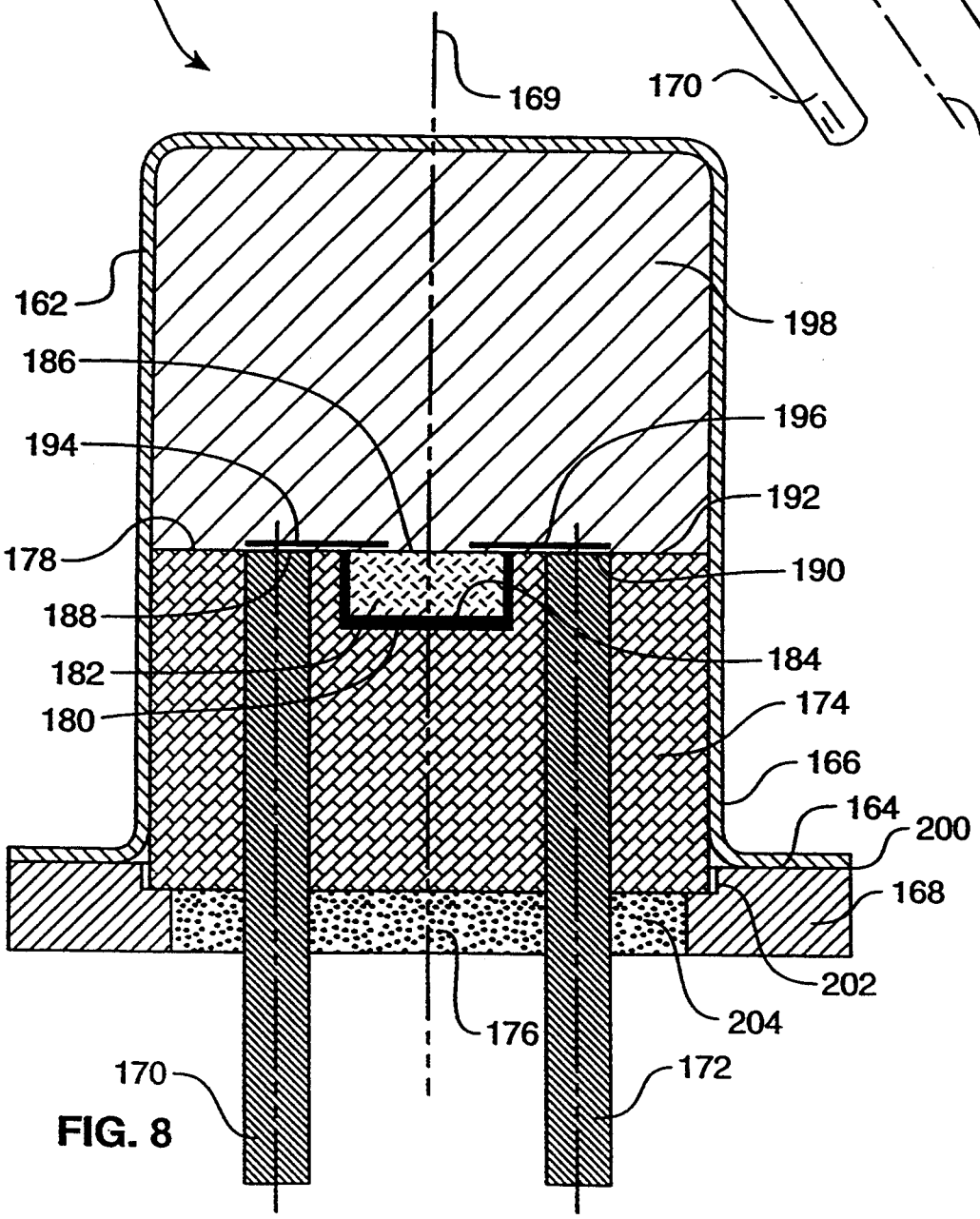
FIG. 8 is an enlarged cross-sectional side view of a further embodiment of the squib of the invention.

The squib 160 of FIGS. 7 and 8 includes a cylindrical metal cap or case 162 having a flange 164 on its open end 166 which is welded to a support base 168. The case 162 is shown as being symmetrical about axis 169. Two electrically conductive pins 170 and 172 pass through an insulation disc 174. Disc 174 is made from a moldable or machinable, electrically insulating material which is compatible with a vitreous sealing material 176 such as glass or ceramic. Typically, the disc 174 is formed of aluminum oxide $Al_2O_3$. The first surface 178 of the insulator 174 is preferably flat and contains a depression 180 in which an SCB chip 182 is recessed and cemented with an adhesive 184 such as an epoxy cement. As depicted, the first surface 178 of insulating disc 174, the outer surface 186 of SCB chip 182, and the interior ends 188 and 190 of pins 170 and 172, respectively, together form a flat surface 192. Conducting members 194 and 196 connect opposite sides of the SCB 182 to the respective pin ends 188 and 190.

Pyrotechnic material 198 fills the remaining space within the case 162 and is held in a compressed state against the insulating disc 174, SCB chip 182, pin ends 188 and 190, and conducting members 194 and 196.

The conducting members 194 and 196 are shown as tape automated bonds as already described. Alternatively, the members may comprise strips or wire sections as previously described relative to FIGS. 1 through 6. Flange 164 is welded over an entire circumferential course to base 168. Thus, circumferential joint 200 is sealed. Vitreous sealing material 176 seals the opening in the base 168 and completes the hermetic seal of the cup contents. Both pins 170 and 172 are shown insulated from the case 162 and base 168 and, thus nongrounded within the squib itself.

The base 168 is shown with a shallow depression 202 surrounding opening 204. The depression 202 serves as a guide for placement and attachment of the insulation disc 174 and pins 170, 172 to the base 168 by sealing material 176, i.e. glass or ceramic.

Figure 9:
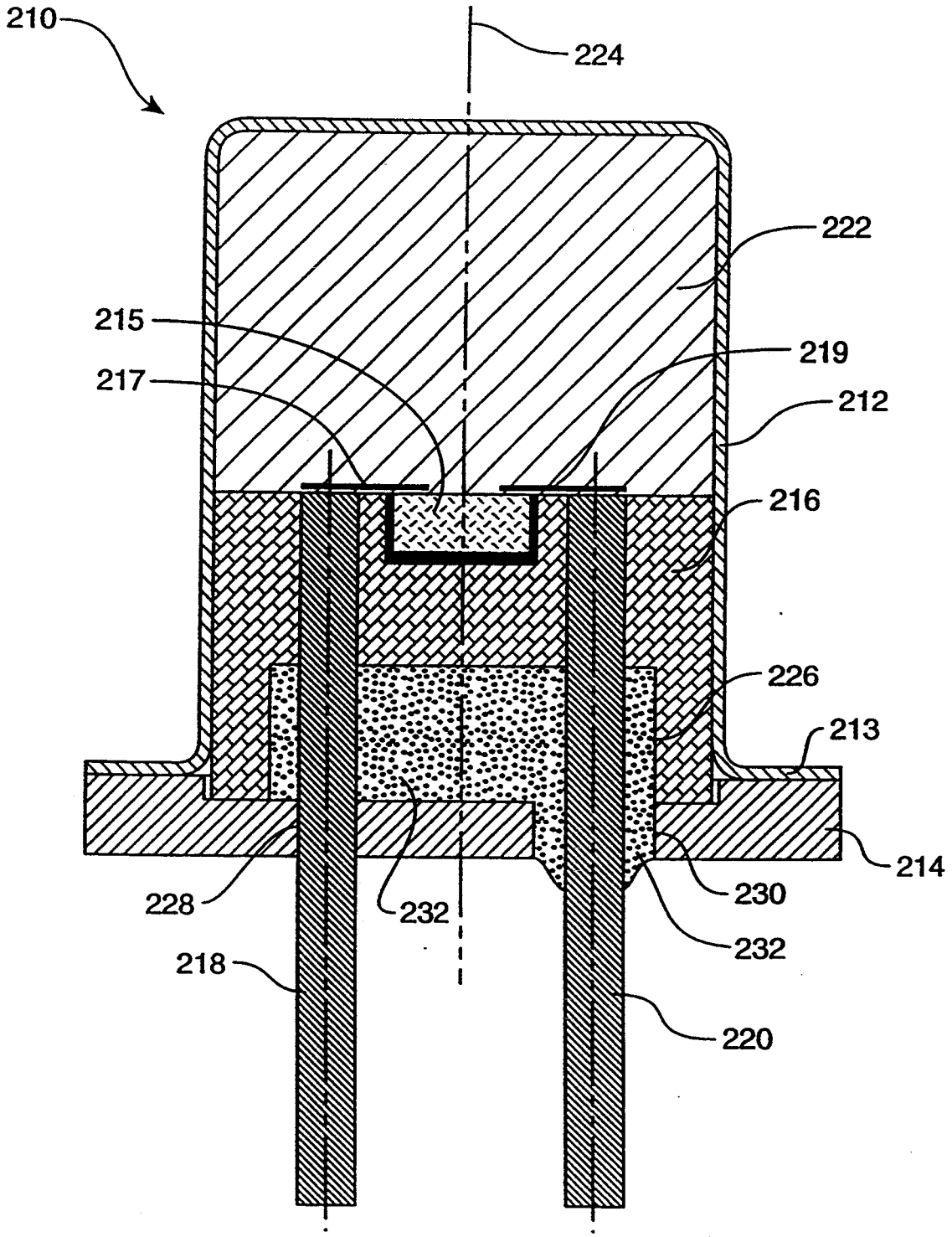
FIG. 9 is an enlarged cross-sectional side view of a still further embodiment of the squib of the invention.

FIG. 9 shows a modified version of the squib of FIG. 8. Squib 210 includes a case 212 with flange 213, base 214, insulating disc 216, pins 218 and 220, and pyrotechnic material 222. The case 212 is symmetrical about axis 224. The SCB chip 215 and conducting members 217, 219 are as previously described.

As shown in the figure, insulating disc 216 has a cut out portion 226 which includes space immediately surrounding the pins 218, 220. As viewed parallel to axis 224, cut out portion 226 may be rectangular, circular, oval, or other shape, but an oval shape is preferred. Alternatively, a separate opening around each pin may be used.

Base 214 is shown as having two openings for passage of pins 218, 220 therethrough. Opening 228 permits pin 218 to be snugly passed through to establish and maintain an electrical continuity between pin 218 and base 214. Thus, pin 218 will be grounded to base 214.

Opening 230 in base 214 is oversized to permit placement of an insulation between the pin 220 and the base. Thus, pin 220 is ungrounded while pin 218 is grounded.

Figure 10:
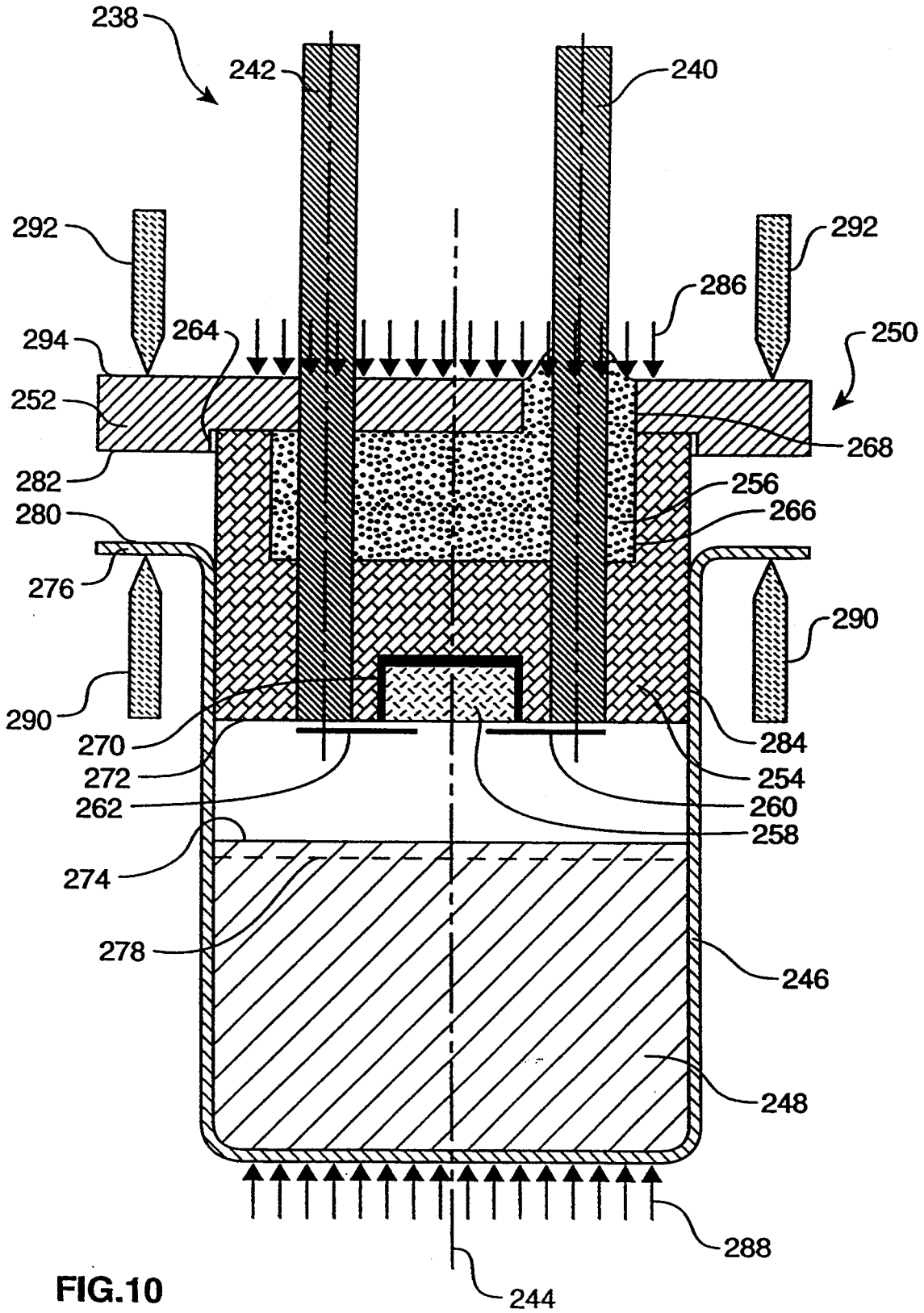
FIG. 10 is an enlarged cross-sectional side view of the squib of FIG. 9 showing the compression and welding process.

A vitreous material 232, i.e. glass or ceramic, is placed in the cut out portion 226 through opening 230 to completely fill the cut out portion and harden, thus sealing the contents of the case 212 from the atmosphere. The process steps for making a squib of FIGS. 7 through 9, according to the invention, may be better understood by reference to FIG. 10. The figure shows the entire assembly inverted with pins 240 and 242 extending upwardly about axis 244.

The manufacturing steps include:

(a) manufacture or procurement of the specific components to be assembled;

(b) joining components into a header subassembly 250; and (c) joining the subassembly, pyrotechnic material 248 and case or cup 246 into a completed squib 238.

The header subassembly 250 includes base 252, pins 240 and 242, insulation disc 254, vitreous sealing member 256, SCB chip 258 adhesively mounted in disc 254, and conducting members 260 and 262 mounted to electrically connect the pins 240, 242 to the respective sides of the SCB chip 258.

Base 252 is typically formed from a thin, e.g. about 0.030 inches thick, sheet of resistance weldable material such as stainless steel or KOVAR®, an alloy of iron, nickel, and cobalt. The shallow depression 264 is typically 0.010 inches deep and 0.72 inches in diameter, and serves to pilot the disc 254 therein. The disc 254, pins 240 and 242, and base 252 are assembled, and the vitreous material 256, e.g. glass, is placed in the cut out 266 through opening 268. Melting and cooling of the vitreous material 256 forms a hermetic seal between the pins and the base.

The SCB chip 258 is then adhesively recessed into depression 270 and the conducting member 260, 262 attached by welding, soldering, or thermal compression. If desired, the pins 240, 242 and the SCB chip 258 may project from the disc surface 272 a short distance. The cup 246 is formed of a resistance weldable metal with thin walls, e.g. 0.005 to 0.01 inch thickness. It may be formed by stamping, machining, or other method. The cup 246 fits snugly around the disc 254 so that particles of the pyrotechnic charge 248 will not travel into the cup-disc interface 284.

A charge of particulate pyrotechnic material 248 is then placed in case or cup 246. Preferably, it is then compressed and debulked by a ram with a pressure of 1,000 to 15,000 psi, preferably 4,000 to 10,000 psi, to attain a level 274 in case 246. Thus, the charge volume is reduced, typically by up to 300 percent, and the charge 248 becomes more cohesive.

Final assembly of the header subassembly 250 and the cup 246 containing the charge of pyrotechnic material 248 is accomplished in a single manufacturing step. The header subassembly 250 is placed into the open end of the cup 246 and the combination placed in a resistance welding machine, not shown, having opposed electrodes 290 and 292. Electrodes 290 are placed on the cup flange 276, and electrodes 292 are placed on the outer surface 294 of base 252. The welding machine uses opposing forces 286 and 288 to squeeze the cup 246 onto the header subassembly 250, further compacting and debulking the pyrotechnic material 248 to level 278. During the compaction step, the machine continually tests for an electrical connection between the upper electrodes 292 and lower electrodes 290. When cup 246 contacts base 252, electrical contact is made. The machine halts further compaction and begins the welding process. To achieve the desired hermetic seal, a continuous weld is made completely around the cup circumference.

Prior to assembly of the squib 238 in the welding machine, a shunt, as previously described, may be applied to prevent possible premature discharge.

Figure 11:
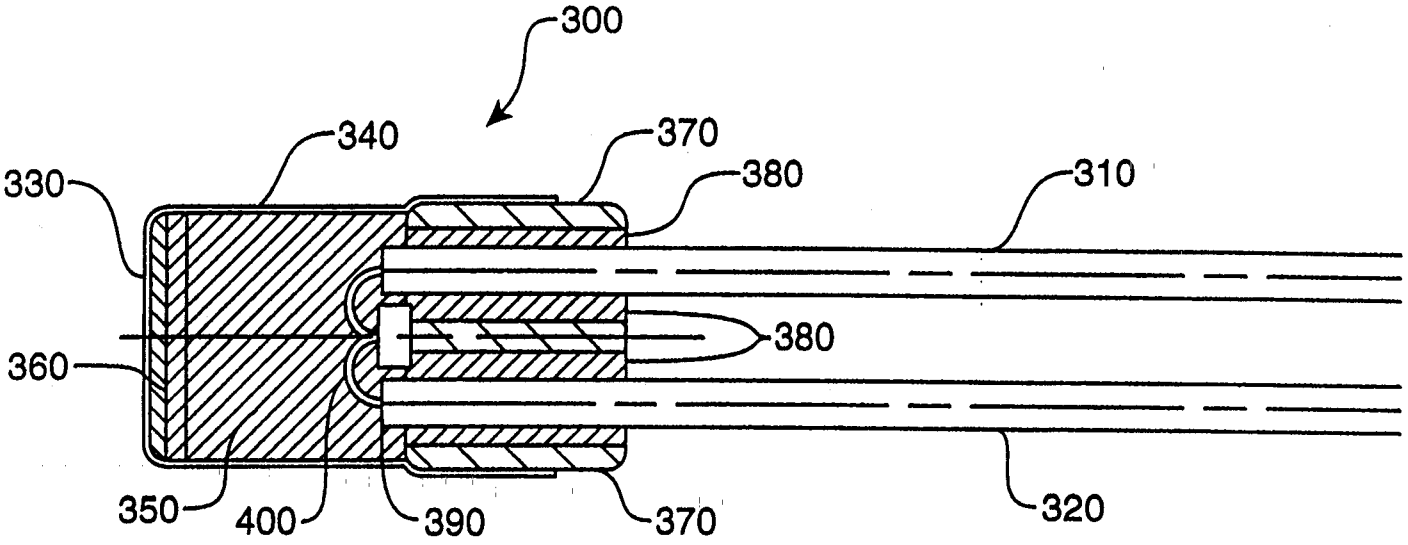
FIG. 11 is an enlarged cross-section side view of an improved, preferred embodiment of the squib of the invention.

FIG. 11 is an enlarged cross-sectional side view of an improved preferred embodiment of the squib of this invention. Igniter squib 300 is composed of cup 340 into which header 370 has been press fitted. Header 370 has pins 310 and 320 which have been sealed by vitreous seal 380 and extend to the top of header 370 which holds SCB 390. Cup 340 contains pyrotechnic material 350 and contiguous to its closed end a resilient material 330 which is covered by rigid plate 360. Also shown is wire loop 400 which connects pins 310 and 320 to SCB 390. The preferred process of assembly of this embodiment is to insert resilient material 330 into cup 340 at the closed end and cover it with the plate 360 before pyrotechnic material charge 350 is added. Then header 370, which has at its top end wire loops 400 and SCB 390, is force-fitted and pressed with compression against pyrotechnic material 350. The header assembly 370 is also nickel plated prior to bonding SCB 390 to the header and wire loops 400 to pins 310 and 320 and to SCB 390. Pin height, length and diameter of pins 310 and 320 are important to the process but can be determined by one skilled in the art. This is also true of the height of wire loop 400 and foot print positions of the wire which are important to the performance of the device and can be determined by one of ordinary skill in the art. The preferred pyrotechnic material 350 is a powder of titanium subhydride potassium perchlorate ($TiH_{6.5-2.0}KClO_4$) or TSPP. In the preferred process of loading the charge, the first increment of TSPP charge each unit is dumped into the cup through a funnel. The charge is then compacted to 5,000 up to 30,000 psi and held for 10 to 30 seconds. The second increment is dumped and compacted at 500 up to 5,000 psi for 1 to 10 seconds. The funnel is removed and a header guide is placed in the tooling. The bridged header guide assembly is placed in the guide and pressed into the powder in the cup 340 at 5,000 up to 30,000 psi for 10 to 30 seconds. Each unit is then circumferentially laser welded to secure the cup to the header. The weld is done at any point in the cup away from the pyrotechnic material 350.

The preferred resilient material 330 is a RTV silicone based rubber or other such elastomeric material. Preferred material for the rigid plate 360 is metal or LEXAN® which is placed on top of the RTV pad. LEXAN® is a carbonate thermoplastic polymer produced by reacting bisphenol A with phosgene. The resilient material 330 and rigid plate 360 must be placed in the cup before the powder or the pyrotechnic material 350 is placed in the cup. The purpose of the RTV pad is to provide a low cost spring-like mechanism to the charge so that positive pressure and initial contact is maintained at all times at the bridge even when the unit is exposed to the harsh environment in use or during qualification testing. The purpose of the lexan disc or rigid plate 360 is to prevent interaction of the RTV pad and the powder or pyrotechnic charge material 350 during compaction and provide even pressure on the charge of pyrotechnic material 350.

The steps of the process of this invention could easily be performed by totally automated equipment with the concomitant low cost. The process is elegant, simple, effective and creates a long service life igniter squib. Also the process permits a weld at any point on the cup away from the pyrotechnic material. The process is the first to compact the pyrotechnic material using a delicate header which has mounted upon it the SCB and very fine wire loops, which contact the pyrotechnic at very high pressure, yet survive to function correctly.

Reference herein to details of the particular embodiments is not intended to restrict the scope of the appended claims which themselves recite those features regarded as important to the invention.

What is claimed is:

1. An igniter squib comprising:

a weldable metallic cup having a generally cylindrical sidewall, a closed end and an open end for placement of an energetic pyrotechnic material therein, said sidewall having an inside diameter, densified pyrotechnic material in said cup said closed end of said cup containing a disc of resilient material, said closed end of said cup having a rigid plate between said disc of resilient material and said pyrotechnic material;

a header having a generally cylindrical outer surface having an outside diameter and having one end thereof generally disposed within said cup, said outside diameter of said generally cylindrical outer surface greater than said inside diameter of said generally cylindrical sidewall of said cup, whereby said header is in a force-fit relationship with said cup, the sidewall of said cup dimensionally deformed as a consequence of said force-fit, said header comprising:

a header body having an interior end and an opposing exterior end; said interior end of said header body maintaining a positive even pressure on said densified pyrotechnic material in said cup, the force-fit relationship between said sidewall of said cup and said outer surface of said header body sufficient to maintain the positive even pressure;

an electrical ignition element mounted on said interior end of said header body and having terminals adapted for connection in an electrical circuit, said ignition element in intimate contact with said pyrotechnic material;

electrically conductive pins having interior and exterior ends, said pins sealingly passing through said header body and each pin having one interior end thereof joined to a respective one of said terminals of said ignition element, each said exterior end of each said pin adapted for connection to a voltage source;

said header having a weldable metallic member hermetically sealed to said cup by a circumferential weld between said cylindrical sidewall of said cup and said cylindrical outside surface of said header.

2. The igniter squib of claim 1 wherein said electrically conductive pins are sealed to said header by an electrically insulative vitreous solid.

3. The igniter squib of claim 2, wherein said vitreous solid comprises one of glass and ceramic.

4. The igniter squib of claim 2 wherein said vitreous solid comprises glass fused to said pins and said header at elevated temperature to form a rigid impervious seal therebetween.

5. The igniter squib of claim 2 wherein said vitreous solid comprises a preform.

6. The igniter squib of claim 1 wherein said ignition element comprises a semiconductor bridge (SCB) element.

7. The igniter squib of claim 1 wherein said circumferential weld is one of a laser generated weld and a resistance weld.

8. The igniter squib of claim 1 wherein said pyrotechnic material is selected from the group consisting of titanium subhydride potassium perchlorate, titanium dihydride potassium perchlorate, and boron potassium nitrate.

9. The igniter squib of claim 1 wherein said resilient material is a polymer.

10. The igniter squib of claim 9 wherein said polymer is a silicone rubber contiguous to the entire closed end.

11. The igniter squib of claim 7 wherein said rigid plate is selected from the group consisting of non-resilient plastic and metal.

12. The igniter squib of claim 11 wherein the rigid plate is a thermoplastic carbonate-linked polymer produced by reacting bisphenol A and phosgene.

13. The igniter squib of claim 1 wherein a portion of said electrical ignition element is connected to a loop of wire, which is also connected to one of the electrically conductive pins.

14. A process for manufacturing an igniter squib comprising:

forming a cylindrical cup of electrically conductive weldable material, said cup having a closed end, an open end, and a generally cylindrical sidewall between said closed end and said open end, said cylindrical sidewall having an inside diameter and a circumferential surface;

forming a cylindrical header for insertion into said open end of said cup, said header having at least two longitudinal passageways therethrough from an interior to an exterior end and having an electrically conductive weldable member having a circumferential surface mating with said circumferential surface of said cup, said header having an outside diameter slightly larger than the inner diameter of said cup;

mounting an electrically conductive pin in each of said passageways and hermetically sealing said pins in said header whereby at least one of said pins is electrically insulated from said circumferential surface of said header;

mounting an initiating element having electrical terminals on said interior end of said header;

joining each of said pins to a respective one of said terminals of said initiating element;

placing a disc of resilient material in the closed end of said cup;

placing a rigid plate over said disc of resilient material;

placing a measured charge of pyrotechnic material in said cup over said rigid plate;

force fitting said interior end of said header into said open end of said cup to thereby provide a positive even pressure on said pyrotechnic material and deform the sidewall of said cup as a consequence of the force-fit, the force-fit sufficient to maintain the selected positive even pressure; and welding said mating circumferential surface of said header to said mating circumferential surface of said pyrotechnic containing cup in a continuous high-temperature weld to hermetically seal said pyrotechnic material and said initiating element within said cup.

15. The manufacturing process of claim 14 wherein said charge of pyrotechnic material placed in said cup is uncompacted.

16. The manufacturing process of claim 14 further comprising the step of precompacting by ram said pyrotechnic material placed in said cup prior to insertion of said header into said cup.

17. The manufacturing process of claim 14 wherein said weld step comprises one of laser welding and resistance welding.

18. The process of claim 14 wherein said placing of a measured charge of pyrotechnic material is placing a pyrotechnic material which is selected from the group consisting of titanium subhydride potassium perchlorate, titanium dihydride potassium perchlorate, and boron potassium nitrate.

19. The process of claim 14 wherein said resilient material is a polymer.

20. The process of claim 19 wherein said polymer is silicone rubber.

21. The process of claim 14 wherein said rigid plate is selected from the group consisting of non-resilient plastic and metal.

22. The process of claim 21 wherein said rigid plate is a thermoplastic carbonate-linked polymer produced by reacting bisphenol A and phosgene.

23. The process of claim 14 wherein said joining of said pins to said terminals of said initiating element is by wire loops which extend into said subsequently placed charge of pyrotechnic material.

24. An igniter squib comprising:

a cup element closed at one end and open at the other end and having a generally cylindrical sidewall defined by an inside diameter;

a resilient discoid positioned in the interior of the cup element at the closed end thereof;

a rigid plate positioned in the interior of the cup element adjacent the resilient discoid;

a charge of pyrotechnic material in the interior of the cup element adjacent the rigid plate;

a header having an interior end, an exterior end, and a generally cylindrical sidewall defined by an outside diameter, the outside diameter greater than the inside diameter of the sidewall of the cup element;

an initiator means on the interior end of the header for initiating the pyrotechnic material in response to an electric initiation signal;

the header and a portion of the generally cylindrical sidewall thereof force-fit into the open end of the cup to provide a positive even pressure on the pyrotechnic material, the force-fit sufficient to maintain the selected positive even pressure;

a welded connection between the generally cylindrical sidewall of the cup element and the generally cylindrical sidewall of the header; and terminal pin means passing through the header and connected to the initiator for conducting an electric initiation signal to the initiator.

25. The igniter squib of claim 24, wherein said resilient discoid is a polymer.

26. The igniter squib of claim 24, wherein said resilient discoid is a silicone rubber discoid contiguous to the closed end of the cup element.

27. The igniter squib of claim 24, wherein said rigid plate is selected from the group consisting of non-resilient plastic and metal.

* * * * *